US011011151B2

(12) United States Patent
Christoph

(10) Patent No.: US 11,011,151 B2
(45) Date of Patent: May 18, 2021

(54) LOUDSPEAKER ARRANGEMENT

(71) Applicant: Harman Becker Automotive Systems GmbH, Karlsbad (DE)

(72) Inventor: Markus Christoph, Straubing (DE)

(73) Assignee: Harman Becker Automotive Systems GmbH

( * ) Notice: Subject to any disclaimer, the term of this patent is extended or adjusted under 35 U.S.C. 154(b) by 0 days.

(21) Appl. No.: 16/645,926

(22) PCT Filed: Sep. 27, 2017

(86) PCT No.: PCT/EP2017/074477
§ 371 (c)(1),
(2) Date: Mar. 10, 2020

(87) PCT Pub. No.: WO2019/063070
PCT Pub. Date: Apr. 4, 2019

(65) Prior Publication Data

US 2020/0279547 A1 Sep. 3, 2020

(51) Int. Cl.

| | |
|---|---|
| ***G10K 11/178*** | (2006.01) |
| ***F01N 1/06*** | (2006.01) |
| ***H04R 9/02*** | (2006.01) |
| ***H04R 1/02*** | (2006.01) |

(52) U.S. Cl.
CPC ..... *G10K 11/1785* (2018.01); *F01N 1/065* (2013.01); *G10K 11/17825* (2018.01); *H04R 1/028* (2013.01); *H04R 9/022* (2013.01); *G10K 2210/12822* (2013.01)

(58) Field of Classification Search
None
See application file for complete search history.

(56) References Cited

U.S. PATENT DOCUMENTS

| | | | | |
|---|---|---|---|---|
| 2,217,177 | A | 10/1940 | Massa | |
| 5,097,923 | A | 3/1992 | Ziegler et al. | |
| 5,233,137 | A | 8/1993 | Geddes | |
| 5,550,334 | A * | 8/1996 | Langley | F01N 1/065 181/206 |
| 5,748,749 | A * | 5/1998 | Miller | G10K 11/17857 381/71.5 |
| 6,005,957 | A * | 12/1999 | Meeks | F01N 1/065 181/171 |
| 2003/0081808 | A1* | 5/2003 | Kemmerer | H04R 9/022 381/397 |
| 2013/0161124 | A1* | 6/2013 | Neumann | F01N 3/055 181/228 |
| 2013/0161125 | A1* | 6/2013 | Neumann | F01N 1/065 181/228 |
| 2016/0090885 | A1 | 3/2016 | Holsch et al. | |
| 2016/0212543 | A1 | 7/2016 | Kochendoerfer et al. | |
| 2016/0337756 | A1* | 11/2016 | Oliveira | H04R 9/022 |

* cited by examiner

*Primary Examiner* — Harry S Hong
(74) *Attorney, Agent, or Firm* — Angela M. Brunetti

(57) ABSTRACT

A loudspeaker arrangement includes an air-tight, rigid, thermo-conductive enclosure (103) with an aperture (115) and an outer surface, and a loudspeaker (101) air-tightly mounted in the aperture (115) to form a locked acoustic volume within the enclosure (103). The arrangement further includes a multiplicity of thermo-conductive fins (112) attached to or integrated in the enclosure (103) at the outer surface thereof. The multiplicity of fins (112) is distributed over the outer surface of the enclosure (103).

12 Claims, 2 Drawing Sheets

LOUDSPEAKER ARRANGEMENT

BACKGROUND

1. Technical Field

The disclosure relates to a loudspeaker arrangement, particularly applicable in a higher temperature environment.

2. Related Art

Engine order cancellation (EOC) systems and methods are commonly used to reduce noise caused by harmonic disturbances, e.g., in car interiors. Similar systems and methods can also be applied in other environments such as heating, ventilation and air conditioning (HVAC) environments or vehicle exhaust environments. Duct-like arrangements, as they may be used in the environments mentioned above, provide a good basis for the application of active noise control (ANC) including EOC to achieve a global noise reduction. However, these environments may also include obstacles to implementing ANC systems such as, e.g., high ambient temperatures, low ambient temperatures, humidity, moisture and chemically aggressive substances, and, thus, the requirements to sensors and (secondary) sound sources of ANC systems operated in these environments are high. While sensor technology has made some progress, the performance of sound sources when operated under harsh environmental conditions such as high temperatures is still not satisfactory.

SUMMARY

A loudspeaker arrangement includes an air-tight, rigid, thermo-conductive enclosure with an aperture and an outer surface, and a loudspeaker air-tightly mounted in the aperture to form a locked acoustic volume within the enclosure. The arrangement further includes a multiplicity of thermo-conductive fins attached to or integrated in the enclosure at the outer surface thereof. The multiplicity of fins is distributed over the outer surface of the enclosure.

Other arrangements, features and advantages will be, or will become, apparent to one with skill in the art upon examination of the following detailed description and appended figures. It is intended that all such additional arrangements, features and advantages be included within this description, be within the scope of the invention, and be protected by the following claims.

BRIEF DESCRIPTION OF THE DRAWINGS

The arrangements may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Although some of the weaknesses of sound sources to be operated in harsh environmental conditions could be overcome by, e.g., improving their robustness against weak acids, moisture and humidity, other aspects such as high temperatures are still problematic. For example, most of the sound sources of ANC systems used in connection with exhaust systems of combustion engines in vehicles include a loudspeaker tightly mounted in an aperture of a rigid enclosure to provide a sealed acoustic volume. The air mass locked in the enclosure with the mounted loudspeaker generates therein air pressure that depends on the temperature of the locked air mass; the higher the temperature, the higher the pressure. The loudspeaker commonly includes a, compared to the rigidity of the enclosure, softly suspended membrane so that a pressure increase due to an increase of the air mass temperature within the enclosure with mounted loudspeaker mainly forces the membrane outwards from the enclosure shifting the loudspeaker's operating point away from its neutral position. Such a shift of the operating point of the loudspeaker may lead to undesired effects such as restrictions of the dynamic range and a non-linear behavior of the loudspeaker.

Another result of reducing the temperature range of the environment in which the loudspeaker forming the secondary sound source operates is that the durability of the loudspeaker will increase, leading also to more durable ANC (EOC) systems since it has been found that severe durability issues with exhaust ANC (EOC) systems can be tracked to the secondary source.

Figure 1:
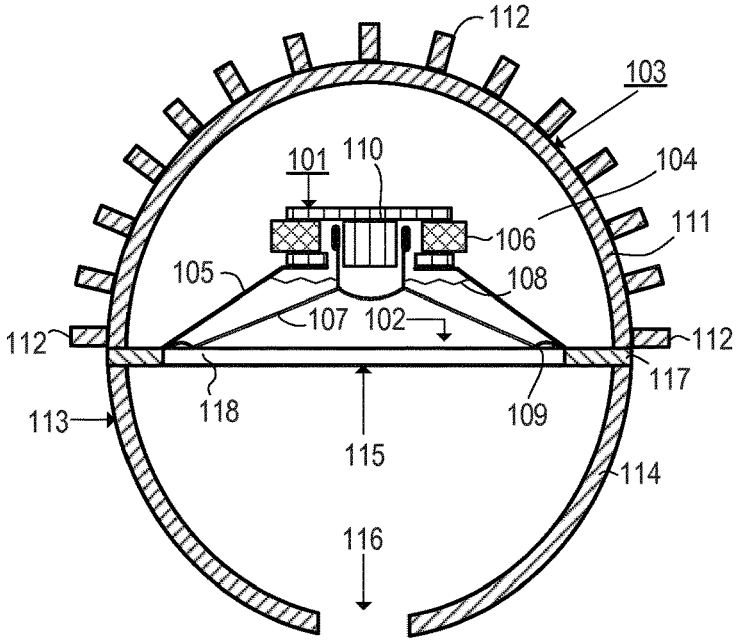
FIG. 1 is a schematic top view illustrating a loudspeaker arrangement employing fins for increasing heat dissipation.

In an exemplary loudspeaker arrangement shown in FIG. 1, a loudspeaker 101 is air-tightly mounted in or at an aperture 102 of rigid, air-tight enclosure 103 so that an air volume 104 with a corresponding air mass is locked within the enclosure 103 when the loudspeaker 101 is mounted thereto. The loudspeaker 101 has a rigid, air-permeable basket 105 as a basic structure to which a magnet system 106 is fixedly mounted and to which a membrane 107 is movably attached via a resilient spider 108 and a resilient suspension 109 to allow for an inward and outward movement of the membrane 107 relative to the basket 105. The basket 105 may be mounted at an edge of the aperture 102 to connect the loudspeaker to the enclosure 103 and the membrane 107 in connection with the suspension 109 seals the aperture 102 so that the volume 104 within the enclosure 103 is locked. The membrane 107 is rigidly and air-tight (e.g., using a dust cap) connected to a voice coil 110 that dips into an air-gap of the magnet system 106.

In the exemplary loudspeaker arrangement shown in FIG. 1, the enclosure 103 may have a shape identical or similar to a cup, semi-spherical shell, spherical shell, box or any other shape suitable to provide in connection with a loudspeaker a sealed acoustic volume. The enclosure 103 includes a thermo-conductive shell 111, e.g., a shell made from or including thermo-conductive material such as metal, metal alloy, ceramics, etc., and a multiplicity of thermo-conductive fins 112 attached to or integrated in the shell 111 at its outer surface. Integrated includes that the fins and the enclosure are one piece. The fins 112 may have a shape identical or similar to gills, ribs, nubs, strips, or any other shape suitable to enlarge the outer surface area of the shell 111 for an improved thermal coupling between the shell 111 and the ambient air. The fins 112 may be made from the same material as the shell 111 or from any other thermo-conductive material. For example the shell 111 and the fins 112 may be one piece (not shown in FIG. 1) or separate parts may be thermally connected to each other (shown in FIG. 1). The air volume 104 may be filled with acoustically damping material such as rock wool, foam, etc.

Heat may be input into the air volume 104 by one or more internal heat sources, e.g., the voice coil 110 (via the magnet system 106), and one or more external heat sources, e.g., exhaust pipes, mufflers, combustion engines that are thermally coupled to the loudspeaker arrangement (via air gaps or thermo-conductive elements such as pipes, couplers etc.). Heat input into the air volume 104 heats up the air volume 104, which thus tries to expand but, due to the dimensional restrictions set by the enclosure 103 in connection with the loudspeaker 101, the air volume is prevented from significantly expanding and the pressure within enclosure 103 with mounted loudspeaker 101 increases, forcing the membrane 107 of the loudspeaker 101 outwards of the enclosure 103 and thereby causing the undesired effects described above. In order to cool the air volume 104, the enclosure 103 is made from or includes thermo-conductive material, and the area of the outer surface of the enclosure 103 is enlarged by way of the fins 112 that are made from or include thermo-conductive material. For example, thermo-conductive material may be considered to be material that has a thermal conductivity of more than 1 W/(k·m). The fins 112 may be of different shape and size, and may be distributed over the outer surface of the enclosure 103 with different distribution densities, but in the present exemplary arrangement the fins 112 are designed so that the resulting area of the outer surface of the enclosure 103 together with the fins 112 is more than 1.5 times (e.g., 2, 3, 4 times etc.) of the surface area of the outer surface of the enclosure 103 without fins 112.

The enclosure 103 may be acoustically coupled to a coupling device 113 with a housing 114 having two opposite apertures 115 and 116. The coupling device 113 may have, for example, a shape identical or similar to a cup with two opposite apertures, a shell or box with two opposite apertures, or any other shape suitable to provide a type of funnel to which, at one aperture, a hose, tube, pipe, channel, or the like can be connected, and to which, at the other aperture, the enclosure 103 can be connected. The coupling device 113 may be coupled to the enclosure 103 by way of a thermo-insulating plate 117 which may reduce heat transmission from the coupling device 113 to the enclosure 103. The thermo-insulating plate 117 has an aperture 118 that corresponds to the aperture 102 of the enclosure 103, and may also serve to mount the loudspeaker 101 to the enclosure 103 (as shown). Alternatively or additionally, the coupling device 113 may be made from or include thermo-insulating material. The position of aperture 118 may correspond to the position of aperture 115 of the coupling device 113. Aperture 116 may provide a connection to a hose, tube, pipe, channel, etc.

Figure 2:
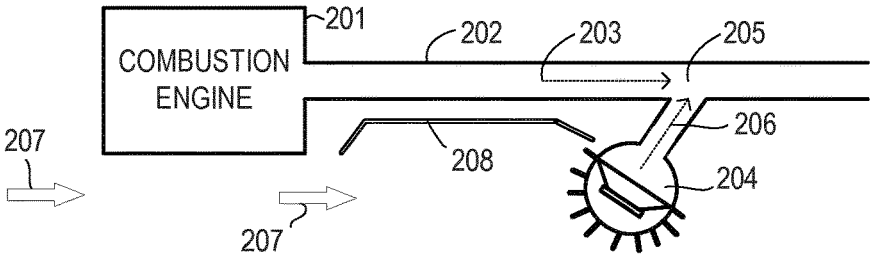
FIG. 2 is a schematic diagram illustrating an application of the loudspeaker arrangement shown in FIG. 1 with a heat shield in connection with a combustion engine.

Referring to FIG. 2, an exemplary application of the loudspeaker arrangement may include a combustion engine 201, to which an exhaust pipe 202 is attached so that hot exhaust gas from the combustion engine 201 is deflected via the exhaust pipe 202. The exhaust gas carries noise 203 that originates from the combustion engine 201 and from gas flow in the exhaust pipe 202. A loudspeaker arrangement 204, which may be identical or similar to that described above in connection with FIG. 1, is acoustically coupled to the exhaust pipe 202 via a Y-pipe 205 having two inputs and an output. One input is coupled to the exhaust pipe 202 and the other input is coupled to an output aperture of the loudspeaker arrangement 204 (e.g., aperture 116 in the loudspeaker arrangement shown in FIG. 1). At the output of the Y-pipe 205 the exhaust gas from the combustion engine 201 is further deflected, however, in the Y-pipe 205 the noise 203 is reduced or even cancelled by cancelling sound 206 generated by the loudspeaker arrangement 204. The cancelling sound 206 destructively interferes with the noise 203 so that little or even no residual noise or sound occurs at the output of Y-pipe 205.

In the example shown in FIG. 2, the loudspeaker arrangement 204 may be exposed to heat according to the following scenarios: (a) Heat may be generated internally in the loudspeaker arrangement 204, e.g., by the loudspeaker enclosed therein; (b) heat generated by the combustion engine 201 may be transferred via an air path directly to the loudspeaker arrangement 204; (c) heat generated by the combustion engine 201 may be transferred to the loudspeaker arrangement 204 via the exhaust pipe 202 and an air path between the exhaust pipe the loudspeaker arrangement 204; and (d) heat generated by the combustion engine 201 may be transferred to the loudspeaker arrangement 204 via the exhaust pipe 202 and the Y-pipe 205.

In view of the heat quantity released by the respective heat source and the thermal conductivity of the path between the source and the loudspeaker arrangement, scenario (d) may input the most heat into the loudspeaker arrangement 204. This heat is dissipated by the enlarged surface of the loudspeaker arrangement 204. To further improve the heat dissipation, the loudspeaker arrangement 204 may be exposed to a relatively cool airstream 207 due to movement of a vehicle (not shown) carrying the loudspeaker arrangement 204. Further, as already described above in connection with FIG. 1, the Y-pipe 205 may be thermally decoupled from the loudspeaker arrangement 204 by way of thermally insulating material, e.g., disposed between Y-pipe 205 and the output of loudspeaker arrangement 204 (such as in the loudspeaker arrangement shown in FIG. 1, around 115) and/or between two parts of the loudspeaker arrangement 204 (such as in the loudspeaker arrangement shown in FIG. 1, enclosure 103 and coupling device 113). In order to also reduce the heat transmission according to scenario (b) and/or scenario (c), a heat shield 208 may be disposed between the combustion engine 201 and/or the exhaust pipe 202 on one side, and the loudspeaker arrangement 204 on the other side. The heat shield 208 is designed to block heat transmission via air path to the loudspeaker arrangement 204. The heat from the loudspeaker in the loudspeaker arrangement 204 according to scenario (a) is deviated so that the loudspeaker's environment within the loudspeaker arrangement 204 is kept cool by the enlarged outer surface of the loudspeaker arrangement 204.

Figure 3:
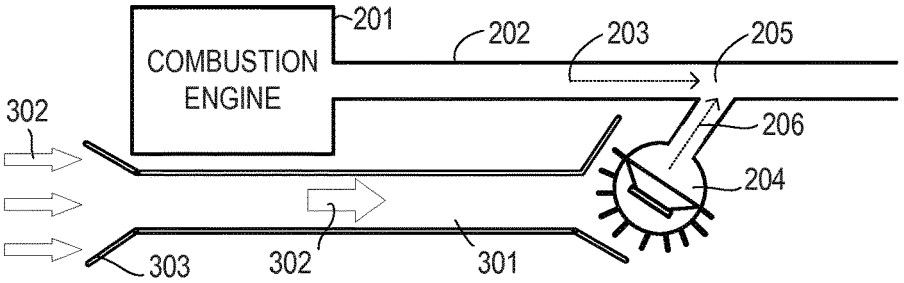
FIG. 3 is a schematic diagram illustrating an application of the loudspeaker arrangement with a venting duct in connection with a combustion engine.
Figure 4:
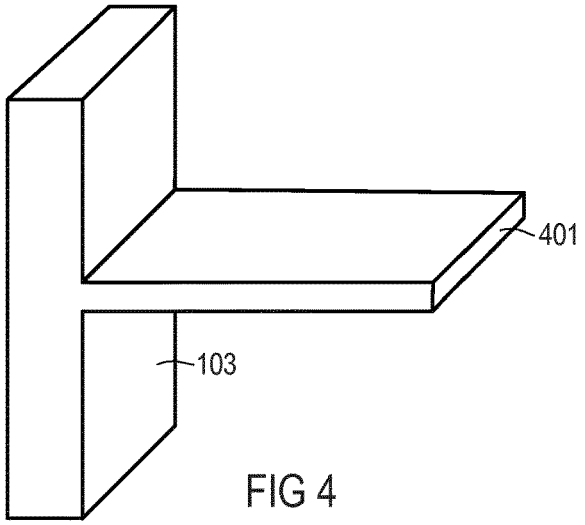
FIG. 4 is a side view of an exemplary fin with a rib-like shape.
Figure 5:
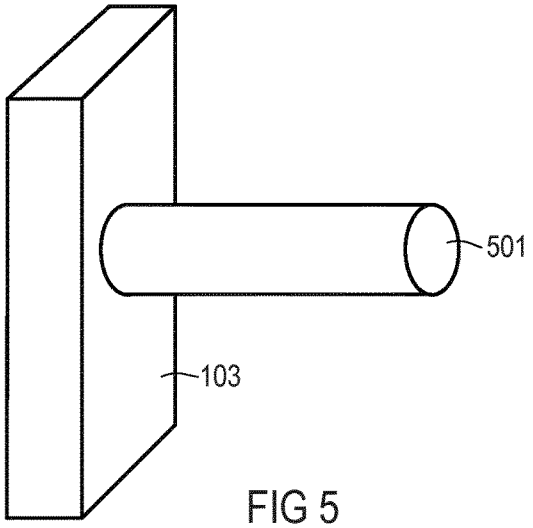
FIG. 5 is a side view of an exemplary fin with a nob-like shape.

Referring to FIG. 3, instead of the heat shield 208 used in connection with the loudspeaker arrangement 204 described above in connection with FIG. 2, a duct 301 such as a pipe, channel, etc. may be employed to guide an airstream 302, e.g., from the front of a vehicle (not shown) to the loudspeaker arrangement 204. The airstream 302 may be intensified by way of a funnel-shaped air inlet 303 of the duct 301. As shown in FIGS. 4 and 5, exemplary fins 401 and 501 applicable as fins 112 to the loudspeaker arrangements described in connection with FIG. 1 may have the shape of a rib (see FIG. 4) or a nob (see FIG. 5). The enlargement of the outer surface of the enclosure 103 depends on the dimensions of the fins and their number. The fins 401 and 501 may be one piece with enclosure 103 which allows for an optimum temperature transmission between the enclosure and the fins due to the absence of any boundaries between them.

Figure 6:
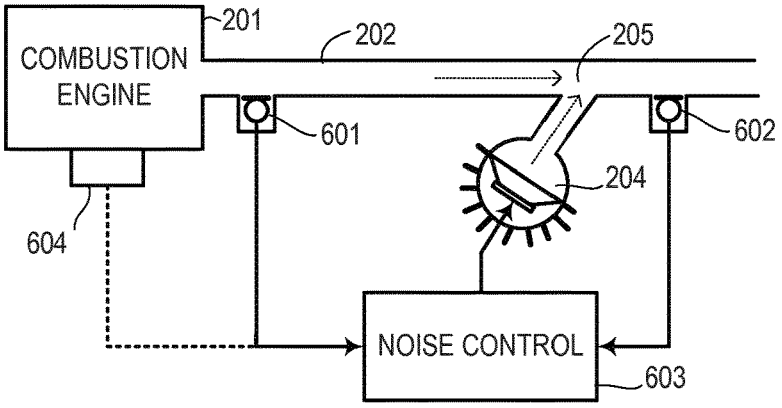
FIG. 6 is a schematic diagram illustrating an exemplary active noise control system with the loudspeaker arrangement shown in FIG. 1.

The loudspeaker arrangements shown in FIGS. 2 and 3 may be used in connection with an engine order control (EOC) system as illustrated in FIG. 6 or any other active noise control (ANC) system. The EOC system shown in FIG. 6 additionally includes a reference microphone 601 and an error microphone 602, which are connected to a noise controller 603, e.g. an EOC controller. The noise controller 603 drives the loudspeaker arrangement 204. The reference microphone 601 is located between the noise source, i.e., the combustion engine 201, and the loudspeaker arrangement 204. The error signal 602 may be disposed downstream of the loudspeaker arrangement and the exhaust pipe 202, e.g., at the output of the Y-pipe 205. Signals (reference signals) from the reference microphone 601 are processed by the noise controller 603 along with (error) signals from the error microphone 602 to generate a drive signal for the loudspeaker arrangement 204. The acoustic path that extends from the combustion engine 201 to the Y-pipe 205 is referred to as the acoustic primary path. The path between loudspeaker arrangement 204 and Y-pipe 205 is referred to as the acoustic secondary path. Since acoustic feedback from the secondary speaker, e.g., speaker arrangement 204, to the reference sensor, e.g., reference microphone 601, is known to cause robustness problems in practical ANC systems it is more reliable to use a non-acoustical reference sensor instead. In the case of machines and engines that predominantly produce periodic signals, a pure reference signal without any interferences can be generated using a non-acoustic sensor system 604, e.g., a rotational speed signal generator in connection with a synthesizer. Suitable algorithms applied in the noise controller 603 are, for example, the least mean square (LMS) algorithm, the filtered U-recursive least mean square (FURLMS) algorithm or the hybrid filtered-X least mean square (HFXLMS) algorithm. Robustness, e.g., stability, of the control algorithm employed can be enhanced by reducing the dynamic of temperature fluctuations in the secondary path. Since the secondary sound source (loudspeaker) is an important part of the secondary path, stabilizing the temperature of the second source increases the robustness of the control algorithm.

The description of embodiments has been presented for purposes of illustration and description. Suitable modifications and variations to the embodiments may be performed in light of the above description or may be acquired from practicing the methods. The described arrangements are exemplary in nature, and may include additional elements and/or omit elements. As used in this application, an element recited in the singular and proceeded with the word "a" or "an" should be understood as not excluding plural of said elements, unless such exclusion is stated. Furthermore, references to "one embodiment" or "one example" of the present disclosure are not intended to be interpreted as excluding the existence of additional embodiments that also incorporate the recited features.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A loudspeaker arrangement comprising:

an air-tight, rigid, thermo-conductive enclosure with an aperture and an outer surface;

a loudspeaker air-tightly mounted in the aperture to form a locked acoustic volume within the enclosure;

a multiplicity of thermo-conductive fins attached to or integrated in the enclosure at the outer surface thereof; the multiplicity of fins being distributed over the outer surface of the enclosure;

a coupling device connected to the enclosure, the coupling device having a housing with two apertures, one of the two apertures having a position that corresponds to the aperture of the enclosure; and a duct in contactless cooperation with the multiplicity of thermo-conductive fins to guide and intensify an air-stream toward the coupling device.

2. The arrangement of claim 1, wherein number and size of the fins is such that the area of the outer surface of the enclosure is enlarged by the fins by at least 50%.

3. The arrangement of claim 1, wherein the fins have the shape of ribs or nobs.

4. The arrangement of claim 1, wherein the coupling device is made from or comprises a thermal insulating material.

5. The arrangement of claim 1, wherein the coupling device is connected to the enclosure via a thermal insulating device.

6. The arrangement of claim 5, wherein the loudspeaker is connected to the enclosure via the thermal insulating device.

7. The arrangement of claim 1, further comprising a heat shield configured to block transmission of heat to the enclosure.

8. The arrangement of claim 1, wherein the enclosure has a shape identical or similar to a cup.

9. An active noise control system comprising:

a reference sensor configured to provide a reference signal representative of noise from a noise source;

an error sensor configured to provide an error signal representative of sound occurring at a position to be silenced;

a noise controller electrically connected to the reference sensor and the error sensor, and configured to provide a noise cancelling signal; and the loudspeaker arrangement according to claim 1, the loudspeaker arrangement configured to receive the noise cancelling signal from the noise controller and to generate noise cancelling sound, and disposed so that the noise cancelling sound is broadcasted to the position to be silenced.

10. The system of claim 9, wherein at least one of the reference sensor and the error sensor is a microphone.

11. The system of claim 9, wherein the reference sensor is a non-acoustical sensor.

12. The system of claim 9, further comprising:

a first pipe-like duct configured to transmit the noise;

a second pipe-like duct configured to transmit the cancelling noise; and a y-pipe connected to the first pipe-like duct and the second pipe-like duct, the y-pipe configured to superimpose the noise and the cancelling noise.

* * * * *